US010640267B2

(12) United States Patent
Krautkramer

(10) Patent No.: US 10,640,267 B2
(45) Date of Patent: May 5, 2020

(54) SCREW CAP FOR LARGE CONTAINERS

(71) Applicant: Bericap GmbH & Co. KG, Budenheim (DE)

(72) Inventor: Gunter Krautkramer, Budenheim (DE)

( * ) Notice: Subject to any disclaimer, the term of this patent is extended or adjusted under 35 U.S.C. 154(b) by 0 days.

(21) Appl. No.: 16/079,704

(22) PCT Filed: Apr. 13, 2017

(86) PCT No.: PCT/EP2017/058965
§ 371 (c)(1),
(2) Date: Aug. 24, 2018

(87) PCT Pub. No.: WO2017/186513
PCT Pub. Date: Nov. 2, 2017

(65) Prior Publication Data

US 2019/0077553 A1 Mar. 14, 2019

(30) Foreign Application Priority Data

Apr. 25, 2016 (DE) ..... 10 2016 107 596

(51) Int. Cl.
*B65D 51/22* (2006.01)
*B65D 47/10* (2006.01)
(Continued)

(52) U.S. Cl.
CPC ..... *B65D 47/103* (2013.01); *B65D 47/36* (2013.01); *B67D 3/0032* (2013.01); *B65D 2547/06* (2013.01); *B67D 2210/00097* (2013.01)

(58) Field of Classification Search
CPC ..... B65D 47/36; B65D 2547/06; B65D 2251/0003; B65D 51/18; B65D 51/22; B67D 2210/00097
(Continued)

(56) References Cited

U.S. PATENT DOCUMENTS

2004/0200837 A1* 10/2004 von Spreckelsen ... B65D 41/04 220/258.1

FOREIGN PATENT DOCUMENTS

DE 39 17 038 A1 12/1990
DE 10 2005 055036 A1 5/2007
(Continued)

OTHER PUBLICATIONS

Olli Sundell, International Preliminary Report on Patentability, PCT/EP2017/058965, European Patent Office, dated Jun. 7, 2018.

*Primary Examiner* — King M Chu
(74) *Attorney, Agent, or Firm* — Paul & Paul

(57) ABSTRACT

A plastic screw cap (100) for large containers, comprises a cylindrical outer jacket (1) having a first internal thread (2) of larger diameter and a head plate (3), which at least partially closes the outer jacket (1) at an axial end, wherein the head plate has an opening (4), which accommodates a removal sleeve (20) having an approximately cylindrical inner jacket having a second internal thread (12) of smaller diameter, which inner jacket protrudes into the interior of the outer jacket, wherein the head plate (3) and the removal sleeve (20) are integrally joined to each other. In order to provide caps of the same functionality that can be produced more simply, the outer jacket (1), according to the invention, together with the head plate (3) on the one hand and the removal sleeve (20) together with the internal thread (2) on the other hand are produced separately from each other by injection molding and are joined to each other fixedly and tightly by welding in order to form the complete screw cap (100).

16 Claims, 7 Drawing Sheets

Figure 1:
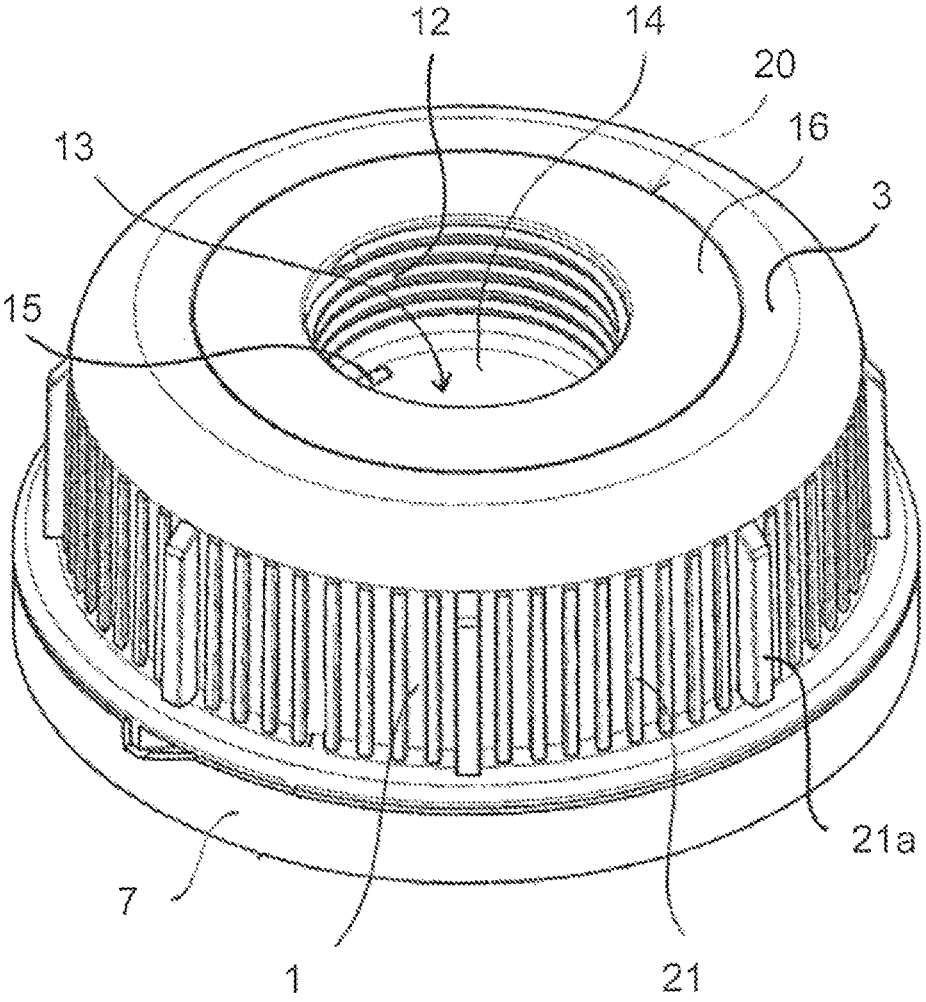

(51) Int. Cl.
*B67D 3/00* (2006.01)
*B65D 47/36* (2006.01)

(58) Field of Classification Search
USPC ..... 220/258.1
See application file for complete search history.

(56) References Cited

FOREIGN PATENT DOCUMENTS

| | | | |
|---|---|---|---|
| GB | 2 297 081 | A | 7/1996 |
| KR | 2014 0006177 | U | 12/2014 |
| WO | 2017186513 | A1 | 1/2017 |

* cited by examiner

SCREW CAP FOR LARGE CONTAINERS

CROSS-REFERENCE TO RELATED APPLICATION

This application is a 371 national stage application of International Application PCT/EP2017/058965, filed Apr. 13, 2017, and claims the priority of German Application No. 10 2016 107 596.5, filed on Apr. 25, 2016.

The present invention concerns a screw closure of plastic for large containers, comprising a cylindrical outer shell having a first female thread of larger diameter and a head plate which at least partially closes the outer shell at an axial end, wherein the head plate has an opening which in turn accommodates a removal sleeve having an approximately cylindrical inner shell which projects into the interior of the outer shell and has a second female thread of smaller diameter, wherein the head plate and the removal sleeve are integrally connected together.

In that case the removal sleeve serves for receiving and fixing a removal spout. Typically such closures are used on large containers of a volume of at least 3 litres and frequently also a volume of 20 litres and more. Corresponding containers are known for example as "5 gallon containers" for receiving (and delivering) drinking water.

Such containers have a container neck or opening connection having a male thread, on to which the outer shell of the closure which has a female thread matching same is screwed. Such screw caps are typically of diameters in the region of 50 to 70 mm. In a wide-spread type of corresponding screw closures and in accordance with an embodiment of the present invention the thread of the outer shell is of a nominal diameter of about 55 mm and the maximum outside diameter is about 70 mm.

In order however to be able to take liquid and in particular drinking water from the container generally that screw cap having the larger diameter is not released, but the liquid is removed rather by way of a removal sleeve arranged in the opening of the head plate of the screw closure of larger diameter. The removal sleeve in turn has a female thread into which a removal spout can be screwed. The internal cross-section of the removal sleeve is closed by a sealing disc which has to be at least partially opened or removed to take liquid from the container.

In the case of smaller containers the sealing disc can have for example a peripherally extending weakening line and a ring eye, by way of which, by engagement with a finger therein, the sealing disc could be torn open along the weakening line and removed from the removal sleeve. In the case of the larger containers in question here, the sealing disc is generally less easy to remove. It is however possible for example to push the sealing disc away at least partially axially and laterally by screwing in a removal spout. To take liquid from the container therefore the consumer screws a suitable removal spout into the (smaller) female thread of the removal sleeve so that the removal spout communicates with the interior of the container, with its inner (open) end. The removal spout desirably has a valve. The container can then be arranged for example upside down (with the screw closure downwards) so that after opening of the valve the liquid, in particular drinking water, runs out of the removal spout solely by virtue of the force of gravity.

By virtue of that structure it is possible to avoid the screw cap of a relatively large diameter having to be released, in which case moreover the screw cap is generally secured to the spout or the opening of the container by an anti-tamper ring which, when the outer screw cap is screwed off the container neck, is severed from the outer shell thereof and that thereby indicates that the screw cap has already been opened at least once. The screw cap of the large diameter and the container neck with a correspondingly large opening serve in particular for quick and efficient filling of the container.

Not least because of the size of the associated containers the number of parts involved in the closures required for same are relatively low as the number of corresponding containers is also relatively low, in particular in comparison with drinking bottles for end consumers. At the same time the production of corresponding closures in an injection moulding mould is relatively costly and complicated as each such closure has to have a cavity which is open at one side, wherein the cavities of the outer closure part and the inner closure part are respectively open in opposite directions and in part also involve undercut configurations. Conventional closures of this kind are accordingly expensive and can only be produced with difficulty in a one-stage conventional injection moulding process.

Therefore the aim of the present invention is to provide closures of the same functionality which however are easier to manufacture. In addition the present invention also defines a process for the production of corresponding closures.

In regard to the closure itself the underlying object of the invention is attained in that the outer shell with the head plate on the one hand and the removal sleeve with its female thread on the other hand are produced separately from each other by injection moulding, wherein those two parts are fixedly and tightly connected together by welding, alternatively by gluing, to form the complete screw closure.

As the two separately produced closure parts are respectively open in themselves only at one side and in that respect can be produced by standard processes and apparatuses the production of the two closure parts each considered in itself is comparatively simple, wherein those closure parts are connected together to afford an integral closure only after they have been produced. In that respect a particular advantage of this closure and the manner of manufacture thereof is that it is possible to use respective conventional injection moulding moulds for the individual closure parts, which moulds for example only need to be equipped with an additional part or modified in order to produce a respective one of the two closure parts required. In that way the separate production can avoid the provision of particularly complicated and expensive injection moulding moulds. Production of the closures according to the invention is therefore markedly less expensive than the injection moulding of the complete closures in a single operation in a moulding tool.

In an embodiment the removal sleeve at its outer end has a flange edge surrounding the sleeve opening for connection to an edge surface surrounding the opening of the head plate. That permits the flange edge to be welded (or glued) to the respectively opposite edge surface, over a relatively large area, whereby the two closure parts are particularly firmly and sealingly connected together.

In order to expedite the welding operation and improve the quality of the weld seal it is possible to provide for example on the side of the flange edge that is towards the head plate or however on the side towards the flange edge of the edge surface surrounding the opening of the head plate, energy direction means which in the welding operation using ultrasound quickly melt and provide a desired fixed and sealed connection to the respectively opposite surface.

Preferably the energy direction means are projections extending axially away from the respective surface and narrowing in a direction away from the surface.

In an embodiment the energy direction means in cross-section are triangular ribs which extend radially and/or in the peripheral direction on the flange edge or the edge surface. Desirably the apex lines of such ribs which are of triangular cross-section are disposed approximately on a common plane parallel at a spacing relative to the plane of the edge surface or the flange edge, on which the ribs are disposed.

In an embodiment the head plate on its outside has an annular recess which surrounds the opening and is set back axially and the dimensions of which are designed for flush accommodation of a flange edge of the removal sleeve. In other words the axial depth of that annular recess corresponds to the axial thickness of the flange edge and desirably also the inside diameter of the recess is the same as the outside diameter of the flange edge so that the head plate outside the recess comes to lie in a common plane together with the surface of the flange edge and the flange edge and the head plate form a common continuous annular surface which extends around the opening of the removal sleeve and defines the head plate of the assembled closure.

At the end of the removal sleeve that is axially opposite the opening at the head plate the removal sleeve has a sealing disc which can be at least partially cut out. In an embodiment such a sealing disc desirably has in the proximity of its outer edge a peripherally extending or at least substantially peripherally extending weakening line, along which the sealing disc can be separated from the remaining part of the removal sleeve. The sealing disc can either partially or completely open the cross-section of the removal sleeve by being cut away. A desirable configuration of the closure is one in which the sealing disc is generally not completely separated from the removal sleeve, but still remains connected to the removal sleeve on one side, that is to say within a small peripheral angular region. That prevents the sealing disc from dropping into a container when it is separated off and thereby causing any trouble.

The sealing disc must also withstand considerable pushing and pulling forces in the region of the weakening line, especially as the closure is typically intended for large containers and for approval must comply mostly with so-called UN test conditions. That includes inter alia a drop test of a filled container with a closure oriented in the direction of the ground so that the container drops on to the closure. As the filled container involves for example a mass of 20 kg or more such a test involves high forces acting on the closure, and both the weld connection between the first and second closure parts and also the weakening line of the sealing disc must withstand such forces. The axial pressure force to be applied at least when tearing open the weakening line is therefore considerable and typically cannot be effected by hand solely with a ring eye and without additional aids. The operation of tearing open the weakening line or partial or complete removal of the sealing discs is therefore not a trivial matter.

The female thread of the removal sleeve is intended to receive a removal spout which typically has a closable removal valve. In that respect it is provided in an embodiment that when screwing in the removal spout an end of the removal spout comes into engagement with the sealing disc and severs it at least partially along the weakening line and presses it in the direction of the interior of the container. Such a removal spout has a hollow-cylindrical end having a male thread, the end of which comes into engagement with the sealing disc when the spout is screwed into the removal sleeve. It will be noted that a considerable torque has to be applied for that purpose to the removal spout or the threaded stem thereof. While the nominal diameter of the female thread of the outer shell is typically and in corresponding embodiments between 38 and 60 mm the female thread of the inner shell of those embodiments is of a typically nominal diameter in the region of 18 mm to 30 mm.

According to an embodiment on its side towards the outside of the closure and in the proximity of the weakening line in a small angular region the sealing disc has a raised portion which when the removal spout is screwed in comes into engagement with the end of the removal spout before other portions of the sealing disc come into engagement with that end of the removal spout. The result of this is that the weakening line of the sealing disc is subjected to a concentrated pulling loading and tears open first there precisely in that portion of the sealing disc where the raised portion is provided.

By virtue of the local delimitation of the pressing force exerted by the removal spout upon being screwed into the thread of the removal sleeve the force required for initially tearing open the weakening line is substantially less than if the end of the removal spout were to come into engagement with the sealing disc simultaneously in an annular region along the weakening line, along a larger peripheral angular portion. The force exerted on the sealing disc when screwing in the removal spout is accordingly first concentrated exclusively on the area around the raised portion, where the weakening line then also tears open first, wherein during further screwing-in of the removal spout, the adjoining portions of the weakening line also gradually tear open, in which case the forces for further severing such weakening lines are only still relatively slight after initial tearing has already taken place. A low pitch angle of the female thread on the removal sleeve can also contribute to reducing the torque required. That is advantageous inter alia because the torque inter alia is transmitted from the inner closure part to the outer closure part by way of the welded connection which is less heavily loaded when the torque is less.

The sealing disc or the weakening line thereof is desirably of such a configuration that, on the side in diametrally opposite relationship to the raised portion, it remains connected to the removal sleeve when the removal spout has been screwed completely in to the removal sleeve. For example the plane of the sealing disc could be slightly tilted (with respect to a plane perpendicular to the axis of the closure) so that the flat end of a removal spout only comes into engagement immediately before reaching an axial end position, with the portion of the sealing disc that is in diametrally opposite relationship to the raised portion.

Alternatively for example a front portion of the removal spout can be radially somewhat narrowed and can form a transition by way of a shoulder into a portion of larger diameter while the removal sleeve outside the weakening line of the sealing disc also has a small, radially inwardly projecting step on which the shoulder fits when the removal spout is screwed as far as possible into the removal sleeve.

In a further alternative the removal spout can also have a shoulder outside the thread, which fits on the flange edge of the removal sleeve before the sealing disc is completely severed from the inner shell of the removal sleeve.

The removal spout and the configuration thereof as such are not part of the present invention, but in particular the removal sleeve is so designed that it comes into sealing engagement with the removal spout in the described fashion when the removal spout is screwed into the removal sleeve and has at least partially pushed the sealing disc into the interior of the container.

The female thread of the removal sleeve has a pitch of at the most 3 mm, preferably at most 2 mm, over 360°, which in the case of plastic closures and with a typical diameter of about 25 mm is to be viewed as a fine thread. The minimum pitch of such a thread is desirably 1 mm at 360°.

The present invention also concerns the two individual parts, from which the closure according to the invention is ultimately produced. In that respect the first part of such a closure which comprises two assembled sealingly connected parts has a cylindrical outer shell with a first female thread of larger diameter and a head plate closing the outer shell at an axial end, wherein the head plate has an opening and wherein there is an annular region axially set back around the opening. In addition such a first part of a closure can also have within the closure thread an annularly peripherally extending seal which extends substantially axially from the head plate and which can come into sealing engagement with the inside surface of a container neck, on to which the outer closure part is screwed.

The second part of such a closure is in the form of a sleeve which is closed On one side at an axial end by a bottom and having a cylindrical inner shell with a female thread and a flange edge extending around the axial opening of the sleeve, wherein near its outer periphery the bottom has a peripherally extending weakening line and on one side a raised portion which is facing outwardly, that is to say towards the opening of the sleeve, near the weakening line, which projects axially relative to the remaining regions near the weakening line.

The terms "outer shell" and "inner shell" are used here to distinguish the two cylindrical shells of the closure which each carry a respective female thread and of which, in the finished closure, the one defines the outer shell of the overall closure and the other defines the shell surrounding the central removal opening.

Each of the first and second closure parts can be relatively easily produced by means of conventional moulds or moulding tools which at best require a slight modification, in which respect the corresponding moulding tools do not have to be of particular complexity. At any event suitable moulding tools are substantially less complicated to produce and construct than a moulding tool which would have to directly produce a closure integrally assembled from the first and second closure parts. It is thus possible to use conventional moulding tools for producing the two individual parts which otherwise serve to produce similar closure elements and which have to be only slightly altered, for example by additional inserts, in order therewith to be able to produce the parts of the closure of the present invention. That is of significance in particular having regard to the relatively small numbers of closures.

Accordingly the present invention also concerns a process for the production of a closure or closure parts, as were described and defined hereinbefore. In that case in a first step the first closure part, namely a first larger screw cap, is produced by injection moulding, having a cylindrical cap shell with a female thread and a head plate which in turn has an opening. In a separate second step the second closure part, namely a removal sleeve, is produced, having at least one cylindrical inner shell having a second female thread. The term "inner shell" is used here to distinguish over the shell of the outer screw cap, that is referred to as the outer shell. The time sequence involved in production of the two closure parts is not fixed in that respect. The terms "first step" and "second step" only serve to distinguish the two operations. The only imperative is that the two closure parts are present before they can be welded together.

The removal sleeve, in relation to the opening in the head plate, is of such a size that it can be oriented in peripheral contact therewith, in which case the correspondingly oriented head plate and the removal sleeve are welded together and are accordingly integrally assembled and in principle form the same or at least a similar configuration as a closure of the above-described kind which is cast integrally from the outset.

Desirably that is achieved by way of a peripherally extending flange on the first closure part, which is welded to an edge surface surrounding the opening of the first closure part, wherein the edge surface and the flange edge are in mutually overlapping relationship in the radial direction.

That can be effected in particular by ultrasound frictional welding, wherein desirably so-called "energy direction means" are provided, which are so adapted that the initial friction is reduced or concentrated to small surface portions which as a result heat up and melt very rapidly. Desirably the energy direction means are distributed substantially uniformly and at close spacings so that the melted material rapidly forms a coherent peripherally extending layer and firmly and sealingly joins together the two closure parts along the outer periphery of the second closure part.

The flange edge could bear both from the inside and also from the outside against the edge surface surrounding the opening in the first closure part, in which respect contact from the outside is preferred, with the edge surface forming in particular the bottom of an axially set-back annular recess in which the flange edge of the first closure part is received.

Figure 2A:
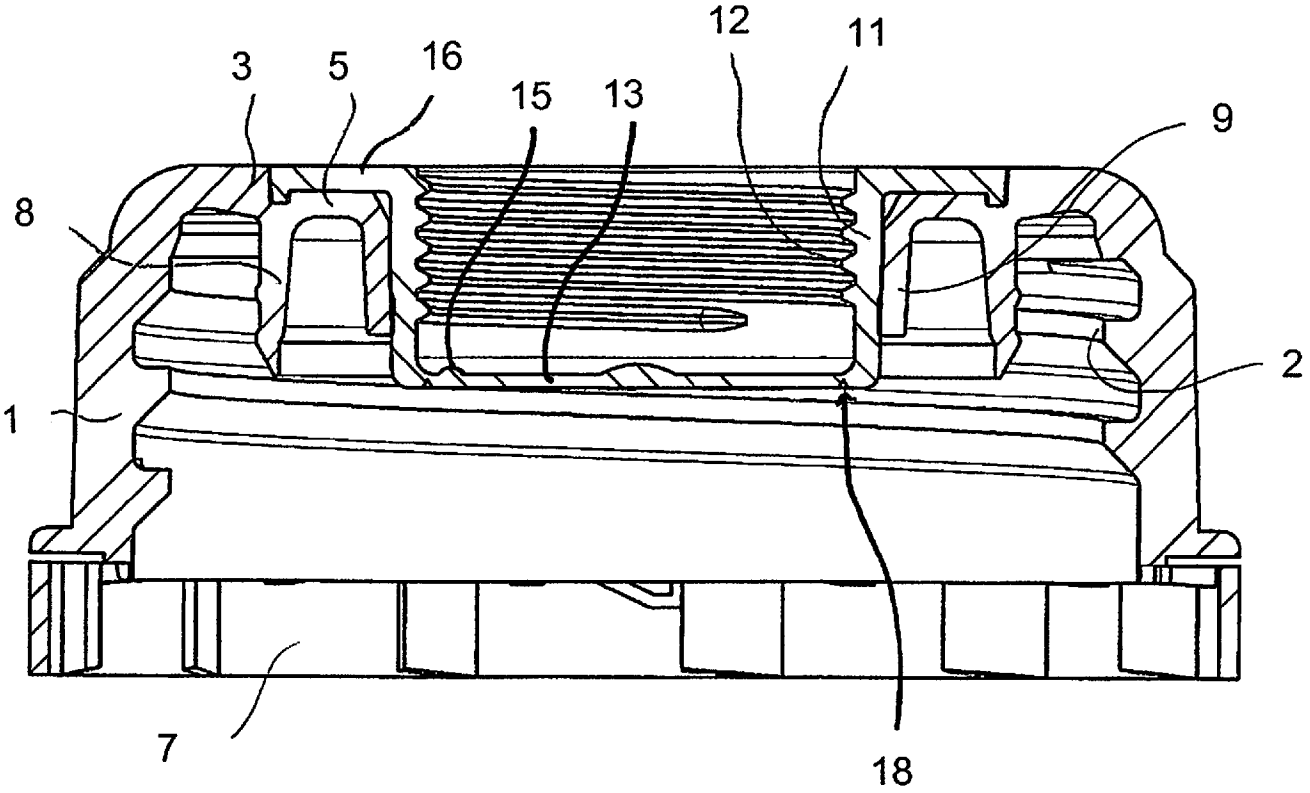
Figure 2B:
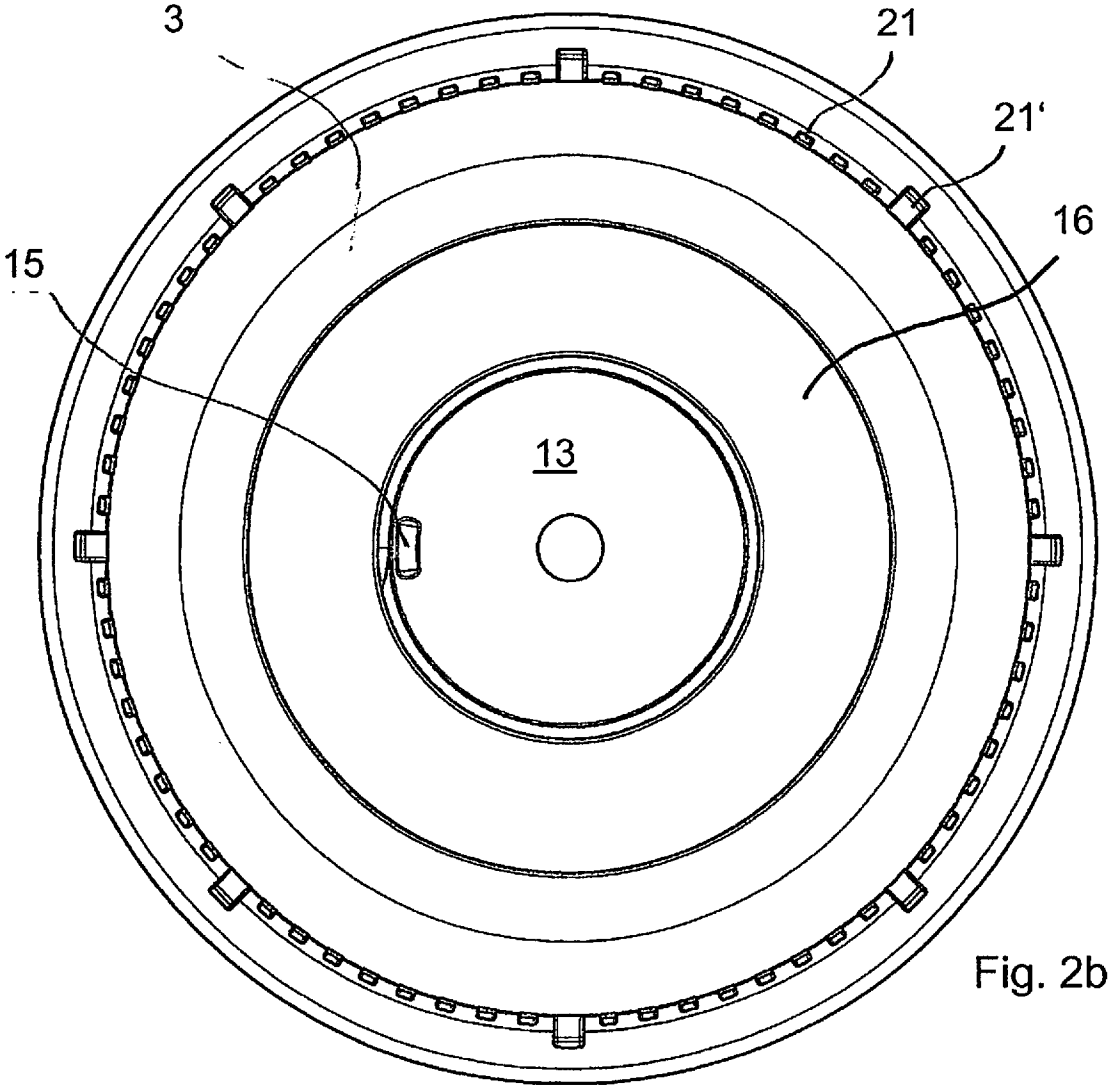
Figure 3:
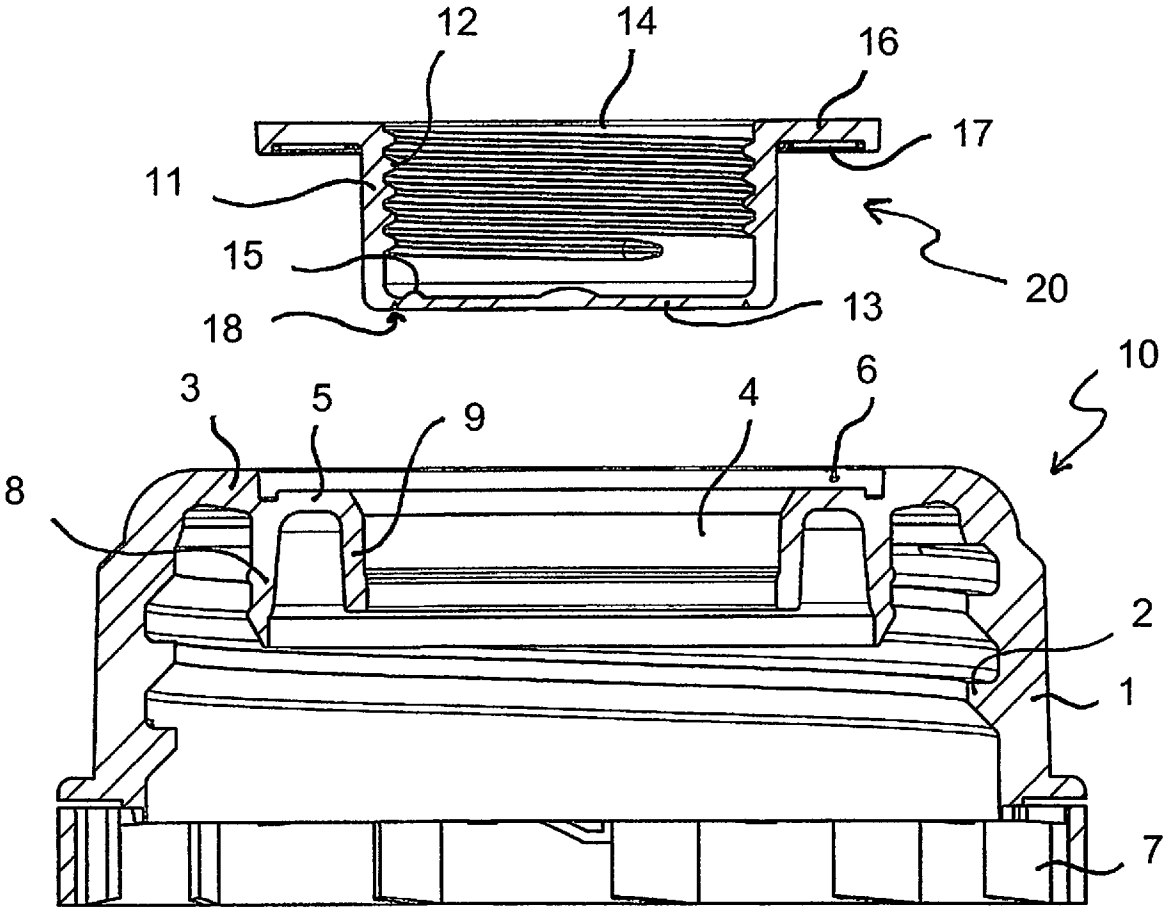
Figure 4B:
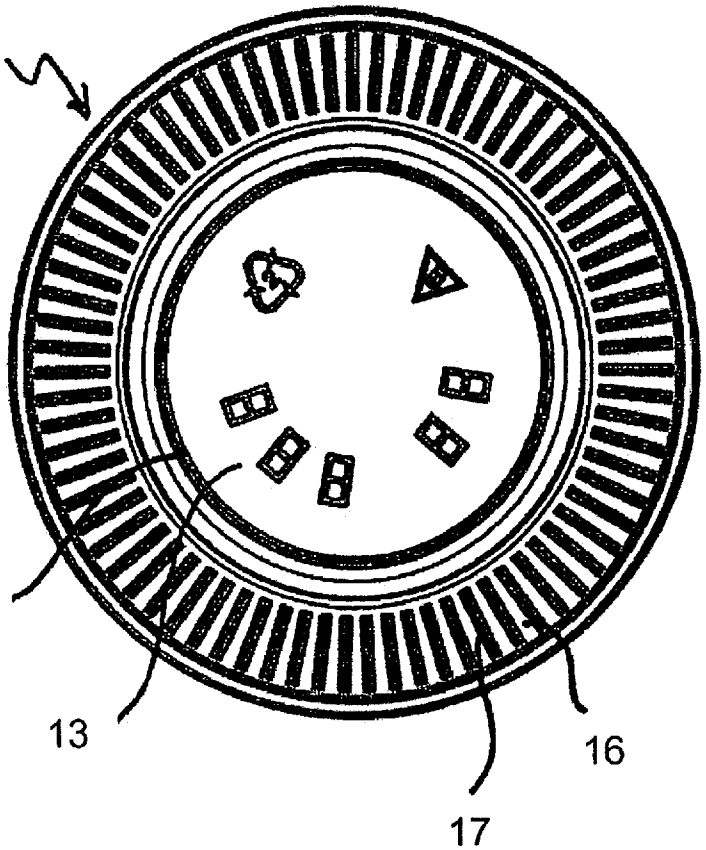
Figure 4A:
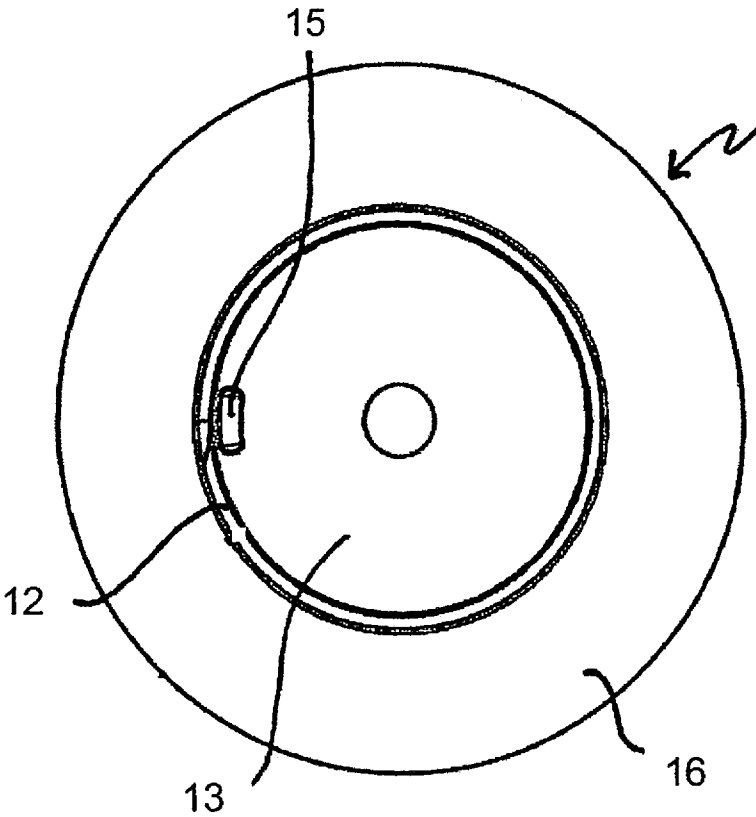
Figure 5:
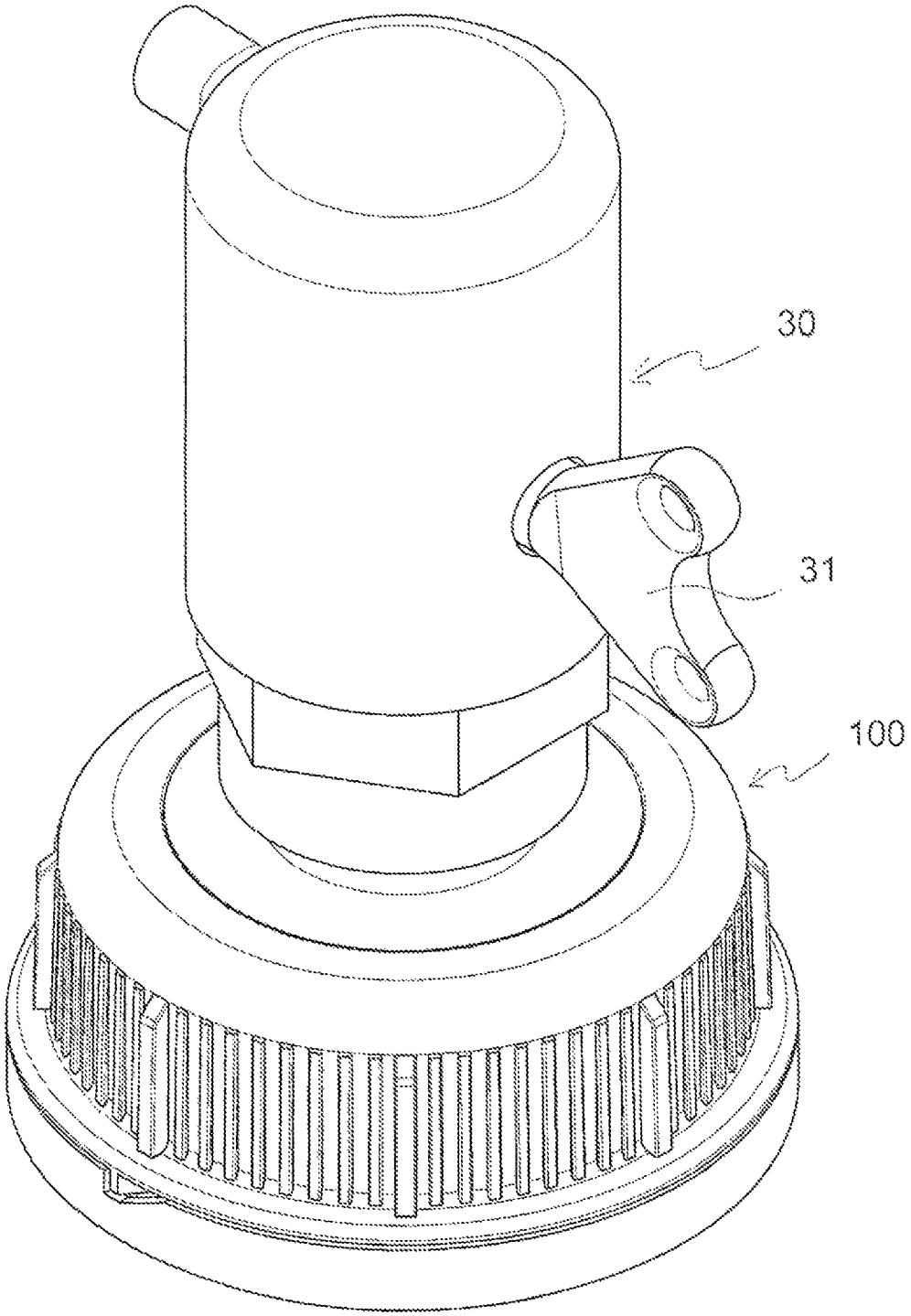
Figure 6:
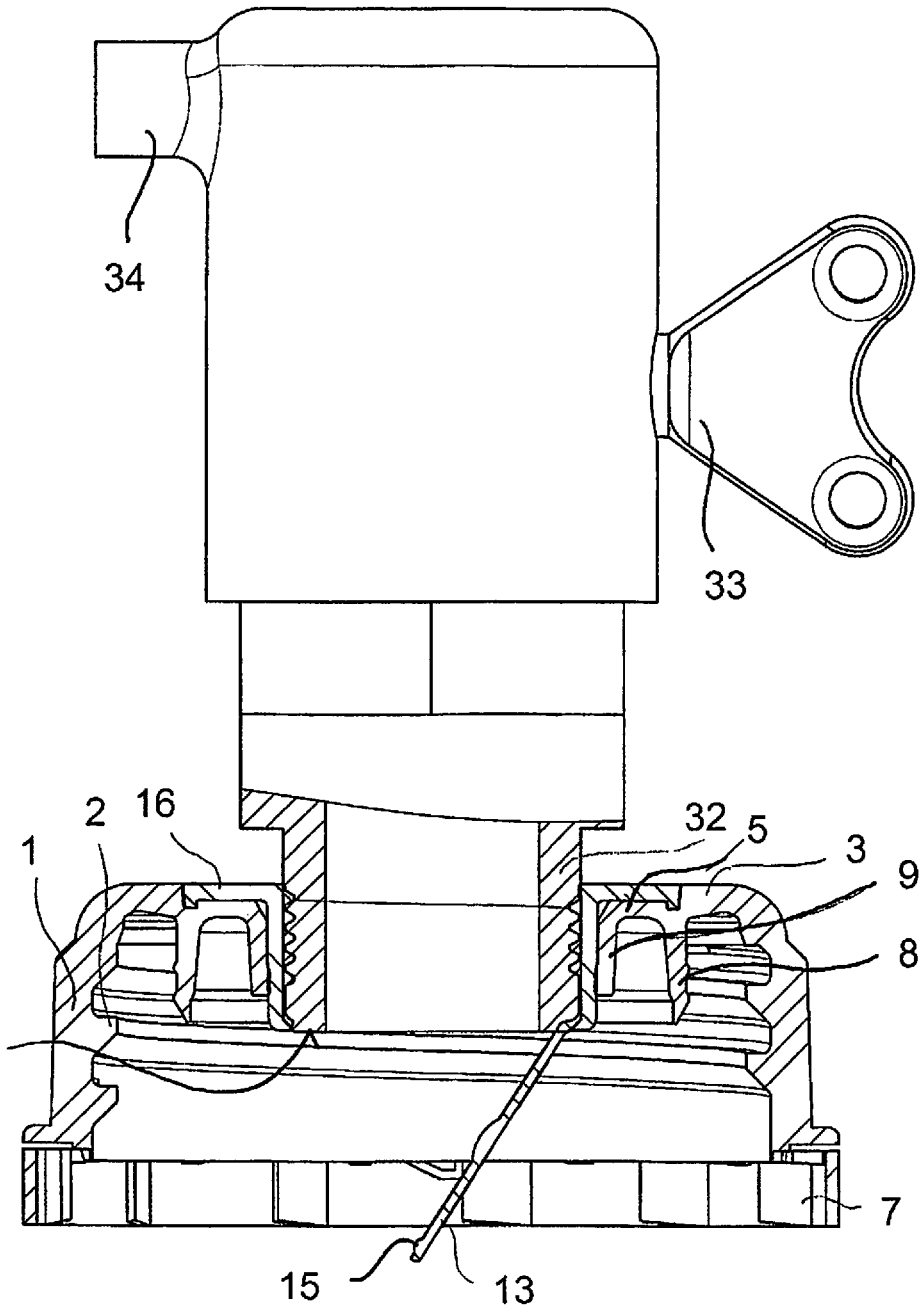

Further advantages, features and possible uses will be apparent from the following description of preferred embodiments and the accompanying Figures in which:

FIG. 1 shows a perspective outside view of the closure consisting of two parts, FIG. 2*a* shows a sectional view containing the axis of the closure through the closure of FIG. 1, FIG. 2*b* shows a view from above or from the outside on to the closure of FIG. 1 and FIG. 2*a*, FIG. 3 shows a sectional view through the two first and the second closure parts in the mutually separated state, FIG. 4*a* shows a view from above on to the second closure part, FIG. 4*b* shows a view from below on to the second closure part, FIG. 5 shows a perspective view of the closure of FIG. 1 with a screwed-in removal spout, and FIG. 6 shows a sectional view through the closure of FIG. 1 with the removal spout screwed in.

FIG. 1 shows a perspective view inclinedly from above and from the outside of the closure 100 which is welded together from two parts. The terms above and outside refer in the present description to the view of a closure which is screwed on to the neck of an upright container. If in use the container is inverted for the removal of drinking water or another liquid the closure is correspondingly disposed at the underside of the container.

The description hereinafter of an embodiment by way of example of the invention refers firstly to FIGS. 1 to 4.

The closure has an outer shell 1, at the lower edge of which is disposed an anti-tamper strip 2 which is connected to the outer shell 1 by easily frangible bridges (not shown). The outer shell 1 has a series of ribs 21, 21*a* which are intended to make it easier to handle the closure, in particular when tightening the closure on a container neck and slackening it therefrom.

The second closure part 20 has a peripherally extending flange edge 16 which is accommodated flush in an annular recess 6 in the head plate 3. The second closure part 20 forms a removal sleeve and has an inner shell 11 having a central opening 14 therethrough and a female thread 12. The opening 14 is closed by a sealing disc 13 at the lower end of the removal sleeve 20.

The two closure parts 10 and 20 can be seen in section in FIG. 2*a*. The outer first closure part 10, as already mentioned, has an outer shell 1 on which a female thread 2 is provided. In addition extending approximately perpendicularly to the shell 1 at the upper end thereof is a transversely extending head plate having an opening 4 (see FIG. 3) which desirably extends concentrically relative to the axis 50 of the closure. Arranged in that opening 4 which is formed or surrounded by a tubular connecting portion 9 is the removal sleeve 20 which in turn has the inner shell 11 with the female thread 12 and at the upper axial end a peripherally extending flange edge 16. The lower end of the removal sleeve 20 is closed by a sealing disc 13 which in turn has a peripherally extending weakening line 18. The annularly surrounding sealing limb 8 which extends downwardly or inwardly from the head plate 3 serves as a closure plug and comes into engagement with the inside wall of a container neck, on to which the screw cap is screwed by means of the thread 2.

The head plate 3 has an axially set-back portion having an edge surface 5 which surrounds the central opening in the head plate 3. The flange edge 16 of the removal sleeve 20 is disposed in the recess 6 formed in that way in the head plate, wherein the flange edge 16 and the edge surface 5 are fixedly and sealingly welded together. The flange edge 16 completely fills up the corresponding recess 6 formed by an axially set-back, annular portion of the head plate 3.

FIG. 2*b* is a plan view from above on to the assembled closure. It is possible to see in particular the ribbing 21, 21' at the outside of the outer shell 1, the head plate 3, the flange edge 16 which is received in a recess in the head plate 3 and the sealing disc 13 at the bottom of the removal sleeve 20, wherein that sealing disc, over a small angular region and near the outer edge of the sealing disc 13, has a raised portion 15, the function of which will be described in still greater detail hereinafter.

The details of the two closure parts can be even better seen in FIG. 3 in which the first closure part 10 and the second closure part 20 are shown separately from each other. The corresponding parts have already been substantially described in connection with FIG. 2*a*.

FIG. 3 further shows so-called "energy direction means" 17 at the underside of the flange edge 16. These involve radial ribs or limbs 17 which are of triangular cross-section and which can also be particularly clearly seen in FIG. 4*b*. The apex lines of those ribs 17 of triangular cross-section define the lower plane of the flange edge 16. The welding operation is implemented by inserting the inner shell 11 into the holding connection portion 9 of the first closure part 10, which extends downwardly or inwardly from the inner edge of the edge surface 5, until the apex lines of the energy direction means 17 rest on the edge surface 5. A sonotrode is brought into engagement with the flange edge and/or the edge surface 5 from opposite sides respectively, whereby the energy direction means 17, in particular the apex regions thereof, are heated and melted and produce a continuous firm weld join to the edge surface 5. In that respect the energy direction means and all adjoining elements like the recess 6 are so designed that, after the welding operation, the outside of the flange edge 16 terminates flush with the top side of the head plate 3, as can be seen in FIG. 2*a*.

The raised portion or projection 15 on the sealing disc 13 is limited to a relatively small angular region, as can be clearly seen in particular from FIG. 4*a*. The purpose of that raised portion 15 is described hereinafter with reference to FIGS. 5 and 6.

FIG. 5 shows once again the closure 100 according to the invention with a removal spout 30 screwed into the opening 14 or the thread 12.

FIG. 6 shows a partly sectional view of the closure with the removal spout screwed into the thread. When the threaded stem 32 is being screwed into the thread 12 of the inner shell the hollow-cylindrical threaded stem 32 finally comes into engagement with the raised portion 15 shortly before reaching an axial end position, in which case the torque applied to the removal spout is converted into a pressure force acting on the raised portion 15, according to the thread pitch. Conversion by the thread 12 makes it possible to exert a sufficient force on the raised portion 15 of the sealing disc 13 so that the weakening line 18, along which the sealing disc 13 is connected to the inner shell 11, tears open in the region of the raised portion 15. When the removal spout 32 is further rotated into its end position the sealing disc 13 is gradually separated away along the weakening line 18 and over almost the entire periphery, but it still remains connected to the inner shell 11 in a small angular region diametrally opposite the raised portion 15.

If desired the weakening line could also be interrupted in that region so that here a firmer connection between the sealing disc 13 and the inner shell 11 persists. If on the other hand an end abutment is provided for the threaded stem 32 there is no need to interrupt the weakening line 18 in order to prevent the sealing disc 13 from being completely separated from the removal sleeve.

The removal sleeve 30 also has a valve 33 and a removal stem 34.

It has been found that a corresponding weld connection between the flange edge 16 and the edge surface 15 is sufficiently firm to carry relatively high levels of torque, as occur in particular when the end of the threaded stem 32 comes into engagement with the raised portion 15 when the removal spout 30 is being screwed into place. The weakening line 18 initially opposes a marked resistance to the attempt to tear it open in that region, but when a corresponding torque is applied and by virtue of the torque conversion effect by virtue of the thread that resistance can be overcome. The corresponding torque however has to be carried by the welded connection between the flange edge 16 and the edge surface 15.

The securing ring 7 serves to make it apparent that a corresponding container on to which the closure 10 is screwed has been opened, because in that way the easily frangible connections between the anti-tamper ring 7 and the lower edge of the screw cap become visible.

The external shape of the entire closure 100 with an outer shell having a female thread and an inner shell having a female thread which surrounds a removal opening is known in principle. Such closures however are conventionally injection moulded in one piece with a correspondingly complex moulding tool. Separate production of the two closure parts 10 and 20 however makes it possible to produce the closure with substantially simpler tools, as are at least in part already available and which at most merely require one additional component or another in order to produce the specifically desired shape, and it is therefore possible to forego using a complex moulding tool if instead the two closure parts 10 and 20 are produced separately and they are then oriented and welded to each other, as was described hereinbefore.

For the purposes of the original disclosure it is pointed out that all features as can be seen by a man skilled in the art from the present description, the drawings and the appendant claims, even if they are described in specific terms only in connection with certain other features, can be combined both individually and also in any combinations with others of the features or groups of features disclosed herein insofar as that has not been expressly excluded or technical aspects make such combinations impossible or meaningless. A comprehensive explicit representation of all conceivable combinations of features and emphasis of the independence of the individual features from each other is dispensed with here only for the sake of brevity and readability of the description.

The invention claimed is:

1. A screw closure (100) of plastic for large containers, comprising a cylindrical outer shell (1) having a first female thread (2) of a first diameter and a head plate (3) which at least partially closes the outer shell (1) at an axial end, wherein the head plate (3) has an opening (4) which in turn accommodates a removal sleeve (20) having an approximately cylindrical inner shell (11) which projects into the interior of the outer shell and has a second female thread (12) of a second diameter smaller than the first diameter, wherein the head plate (3) and the removal sleeve (20) are integrally connected together, characterised in that the outer shell (1) with head plate (3) and the removal sleeve (20) with female thread (2) are produced separately from each other by injection moulding and are fixedly and tightly connected together by welding or gluing to form the complete screw closure (100).

2. A screw closure (100) according to claim 1 characterised in that the removal sleeve (20) at its outer end has a flange edge (16) surrounding the sleeve opening (14) for connection to an edge surface (5) surrounding the opening (4) of the head plate (3).

3. A screw closure (100) according to claim 2 characterised in that prior to the welding operation provided on the side of the flange edge (16) that is towards the head plate (3) and/or on the side towards the flange edge (16) of the edge surface (5) surrounding the opening (4) of the head plate (3), are energy direction means (17) which in the welding operation using ultrasound quickly melt and provide a desired fixed and sealed connection to the respectively opposite surface.

4. A screw closure (100) according to claim 1 characterised in that the energy direction means (17) provided on the flange edge (16) or the edge surface (5) are projections which extend axially from the respective surface and narrow away from the surface.

5. A screw closure (100) according to claim 4 characterised in that the energy direction means are ribs (17) of triangular cross-section which extend radially and/or in the peripheral direction.

6. A screw closure (100) according to claim 1 characterised in that the head plate (3) on its outside has an annular recess (6) which surrounds the opening (4) and is set back axially and the dimensions of which are designed for flush accommodation of a flange edge (16) of the removal sleeve (20).

7. A screw closure (100) according to claim 1 characterised in that at its inner end the removal sleeve (20) has a sealing disc (13) which can be at least partially separated out.

8. A screw closure (100) according to claim 7 characterised in that the sealing disc (13) has a peripherally extending weakening line near its outer edge.

9. A screw closure (100) according to claim 8 characterised in that provided in a limited peripheral angular region on the sealing disc (13) and near the peripherally extending weakening line (18) is an axially outwardly projecting local raised portion (15) for engagement with a removal spout (30) which is to be screwed into the female thread (2).

10. A screw closure (100) according to claim 8 characterised in that the weakening line (18) is such that the weakening line does not rupture when subjected to a drop test comprising dropping a filled container of a mass of up to 25 kg from a height of 1 m, the filled container sealed with the screw closure, without the weakening line tearing open.

11. A screw closure (100) according to claim 1 characterised in that the female thread (2) on the removal sleeve (20) has a pitch of at most 3 mm over 360°.

12. A screw closure (100) according to claim 11 characterised in that the female thread (2) on the removal sleeve (20) has a pitch of at most 2 mm over 360°.

13. A part (20) of a closure (100) comprising two assembled, sealingly connected parts (10, 20), wherein the part (20) in the form of a sleeve closed at one end by a bottom, a cylindrical shell with a female thread of a second diameter and a flange edge (16) surrounding an axial opening in the sleeve, wherein the bottom has a peripherally extending weakening line (18) near its outer periphery and on one side has a raised portion (15) facing towards the open side and near the weakening line, which axially projects with respect to the other regions near the weakening line (18), characterized in that at its underside the flange edge (16) has energy direction means (17) provided for welding the flange edge (16) to an oppositely disposed surface of a different part (10) of a closure.

14. A process for producing a closure (100) and closure parts (10, 20) according to claim 1 characterised in that in a first step a first larger screw cap is produced by injection moulding, which has a cylindrical cap shell having a female thread and a head plate (3) which in turn has an opening (4), wherein in a second separate step a removal sleeve (20) is produced, which has at least one cylindrical inner shell having a second female thread, wherein the removal sleeve in comparison with the opening (4) of the head plate (3) is of such a size that in that way it is oriented and can be oriented in peripheral contact therewith, and the head plate (3) is welded to the removal sleeve (20).

15. A process according to claim 14 characterised in that the removal sleeve (20) and the head plate (3) are welded together by ultrasound friction welding.

16. A process according to claim 14 for producing a closure (100) characterised in that on the outside or inside a flange edge (16) bears against a region of the head plate (3) surrounding an opening (4), wherein in a third step the flange edge (16) is welded to the region surrounding the opening (4) in the head plate (3).

* * * * *